United States Patent [19]

Dusch

[11] 4,422,398

[45] Dec. 27, 1983

[54] TOP FEED DEVICE FOR A SEWING MACHINE

[75] Inventor: Albert Dusch, Kaiserslautern, Fed. Rep. of Germany

[73] Assignee: Pfaff Industriemaschinen GmbH, Fed. Rep. of Germany

[21] Appl. No.: 268,154

[22] Filed: May 29, 1981

[30] Foreign Application Priority Data

Aug. 22, 1980 [EP] European Pat. Off. ..... 80105004.8

[51] Int. Cl.[3] ..... D05B 27/04

[52] U.S. Cl. ..... 112/320

[58] Field of Search ..... 112/320

[56] References Cited

U.S. PATENT DOCUMENTS

| | | | |
|---|---|---|---|
| 3,583,344 | 6/1971 | Meier et al. | 112/320 |
| 3,935,826 | 2/1976 | Nicolay et al. | 112/320 |
| 4,116,145 | 9/1978 | Nicolay | 112/320 |

*Primary Examiner*—Werner H. Schroeder
*Assistant Examiner*—Andrew M. Falik
*Attorney, Agent, or Firm*—McGlew and Tuttle

[57] ABSTRACT

A transport device for a sewing machine having a housing, a feeder foot and a fabric presser foot, a drive mechanism for driving the feeder foot and the presser foot, a transmission operatively interconnecting the presser foot and the feeder foot to the drive mechanism for alternately reciprocating the feeder foot and the presser foot relative to each other in up and down motions directed perpendicular to a stitch plate of the sewing machine, comprises linkages which cause the feeder foot and the presser foot, during their up and down motion, to move at a speed approaching zero during a touchdown phase of the motion. The transmission includes an eccentric connected to the drive mechanism which oscillates at a selected frequency. A triangular lever is connected to the feeder foot and the presser foot. A coupling member is connected to the eccentric and to the linkages with a link of the linkages pivotally mounted to the sewing machine housing and interconnecting the coupling member with the triangular lever. The transmission also includes a steering arm mechanism for providing a variable transmission ratio between the eccentric and the coupling member. A further linkage transmission connected to the drive mechanism varies the transmission ratio of the steering mechanism, the linkage transmission operating at twice the frequency of the steering mechanism.

5 Claims, 5 Drawing Figures

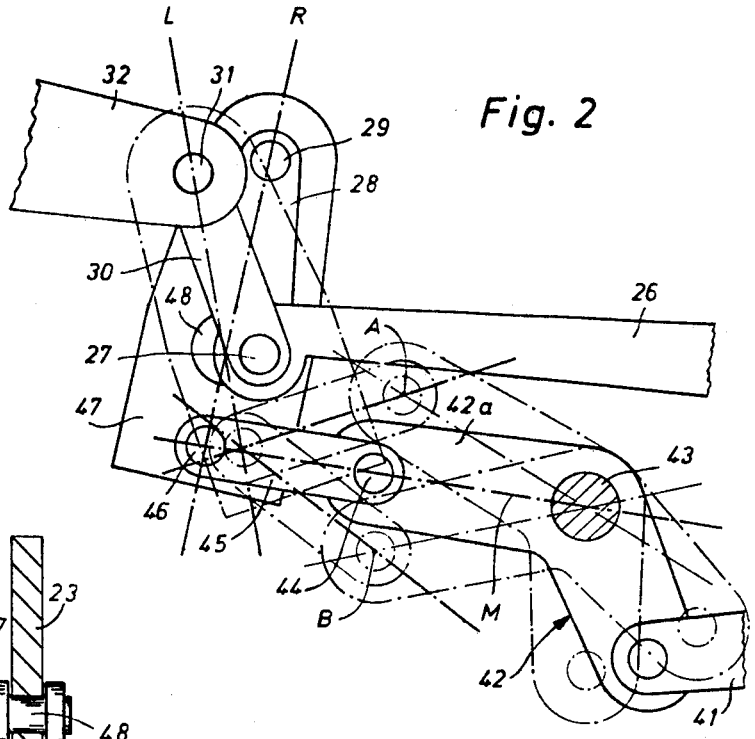
Fig. 2
Fig. 3
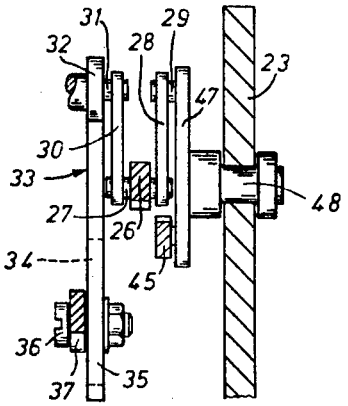
Fig. 4
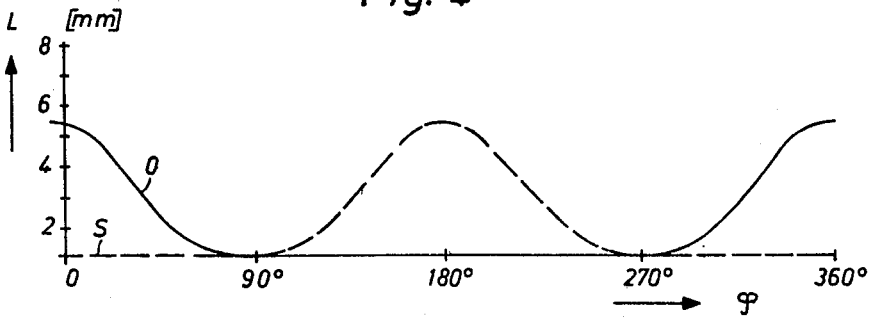

TOP FEED DEVICE FOR A SEWING MACHINE

FIELD AND BACKGROUND OF THE INVENTION

The present invention relates, in general to sewing machines and in particular to a top transport sewing machine having a feeder foot and a fabric presser foot where the presser foot alternatingly interacts with the feeder foot. A coupling member is driven by an eccentric through a transmission via a triangular lever linked to the coupling member, for imparting, to the feeder foot and presser foot, up and down motions directed perpendicularly to a stitch plate, and in which the speed of the up and down motion approaches zero during a touch down phase of the feet.

A known top transport sewing machine is disclosed in U.S. Pat. No. 4,116,145. The uneven lifting motion in this machine is disadvantageously generated by a slide-push guide arrangement. This slide-push guide is not only difficult to manufacture, but also has unfavorable operating characteristics and is subject to great wear which can be reduced only by sophisticated lubrication. Since the top transport mechanism and its drive are housed in the head of the machine, in which a full lubrication system cannot be provided for known reasons, the use of a slide push guide within this drive is problematical for high-speed sewing machines.

SUMMARY OF THE INVENTION

It is an object of the present invention to provide a long-wearing lifting drive for the top transport mechanism of a sewing machine.

According to the invention, a steering gap transmission is provided which has a transmission ratio that is varied by a linkage transmission acting with twice the frequency of the steering arm transmission. This results in an almost maintenance free drive transmission for the lifting drive, which is now also suited for high sewing speeds.

Other advantageous embodiments of the drive transmission are provided in which the linkage transmission has a second eccentric which is driven by the main shaft of the sewing machine and is joined to the steering arm transmission via an eccentric rod, a rocker, a coupling member and a rocking lever. The coupling member and rocker oscillate between two points (A and B) which are the same distance apart from an extended or stretched position of the coupling member and an arm of the rocker connected thereto. In accordance with one of the embodiments of the invention, the linkage transmission has an eccentric which is driven by a main shaft at a 1:2 ratio and is connected, via an eccentric rod, to a lever arm of the rocker, having the same length as the steering arm of the steering arm transmission. Moreover, due to the adjustability of the two drive eccentrics relative to each other, the timing of the slow phase of the lifting motion is adjustable to a certain extent so that optimal adaptation of this phase of the motion to the touchdown motion cycle of the feed is achievable.

Thus, it is a further object of the invention, to provide an improved top transport device for a sewing machine having a housing, a feeder foot and a fabric presser foot, drive means for driving the feeder foot and the presser foot, transmission means operatively interconnecting the presser foot and the feeder foot to the drive means for alternatingly reciprocating the feeder foot and the presser foot relative to each other in up and down motions directed perpendicular to a stitch plate of the sewing machine, such that the speed of the up and down motion approaches zero during a touchdown phase of the feet. The transmission means are of the type which have an eccentric connected to the drive means, a triangular lever pivotally connected to the housing interconnecting the feeder foot and the presser foot, a coupling member connected to the eccentric, and a linkage system having a link pivotally mounted to the housing and interconnecting the coupling member to the triangular lever. The transmission means further includes a steering arm transmission having a variable transmission ratio interconnecting the eccentric and the coupling member.

It is a further object of the invention to provide an improved top transport device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 2 is a partial section of the lifting drive, according to FIG. 1, on an enlarged scale;

FIG. 3 is a sectional view taken along line III—III of FIG. 1;

FIG. 4 is a diagrammatic representation of the lifting motion of the top transport foot and of the fabric hold-down foot.

DESCRIPTION OF THE PREFERRED EMBODIMENTS

Figure 1:
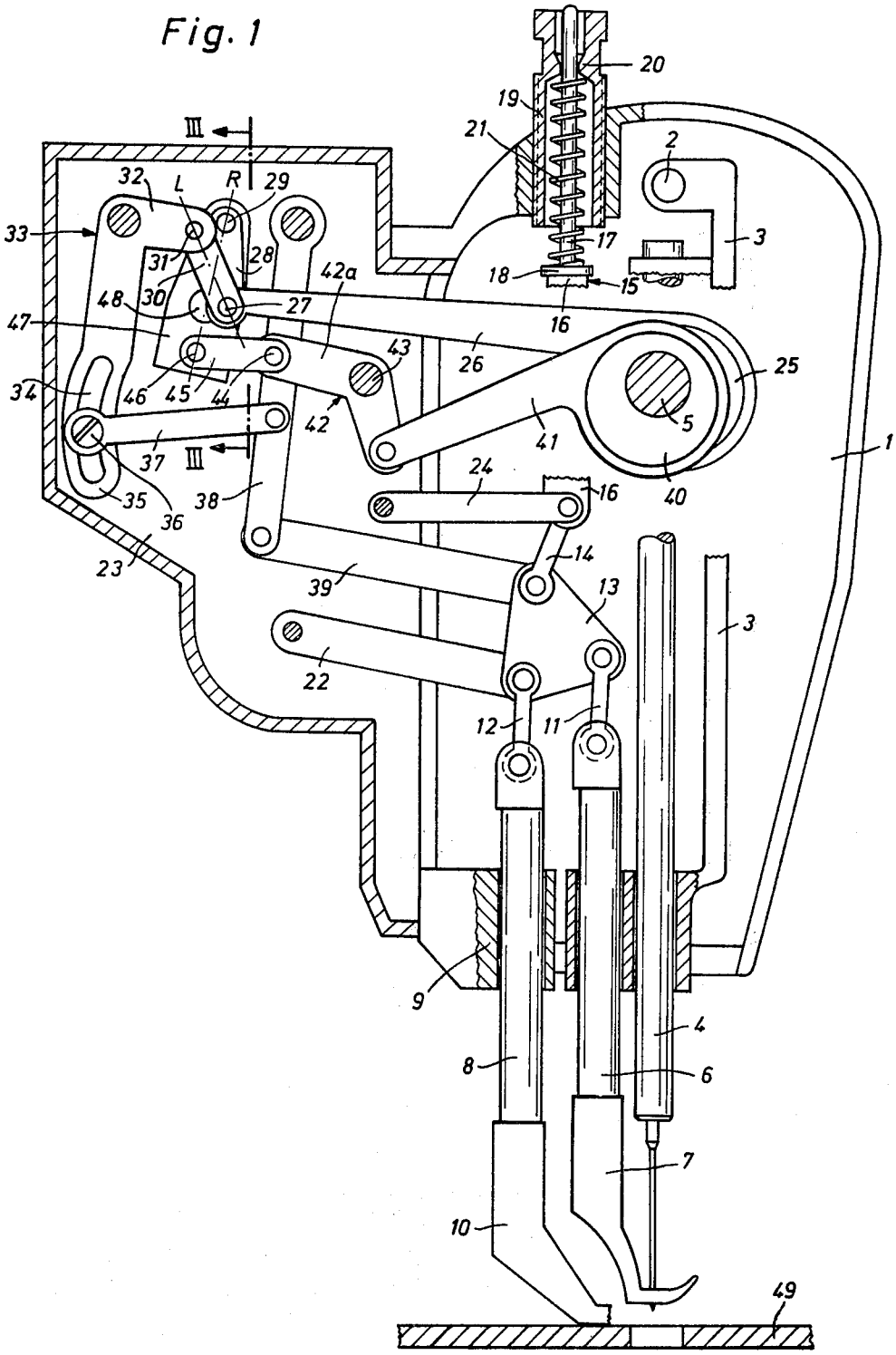
FIG. 1 illustrates a front view of a sewing machine with a head cover removed, partly in section, with a first embodiment of the lifting drive.

Referring now to the drawings wherein like reference characters designate like or corresponding parts throughout the several views, there is shown a guide rocker 3 mounted by means of a bolt 2 to a head 1 of a sewing machine. A needle bar 4 is guided in the rocker 3 for up and down motion. The drive for the needle bar 4, taken from an arm shaft 5, is not shown. A top transport bar 6 is also mounted in the guide rocker 3. The lower end of the top transport bar 6 supports a top transport foot 7. A fabric presser foot bar 8 is mounted parallel to the top transport bar 6 in a guide 9, fixed to the housing, in the head 1. A fabric presser foot 10 is fastened to the lower end of the fabric presser bar 8. Both the top transport bar 6 and presser foot bar 8 are respectively connected, each by a single steering arm 11 and 12 at their upper end, to a triangular lever 13 which in turn is connected to a rod 15 via another steering arm 14. The rod 15 is composed of a lower rod portion 16 and an upper rod portion 17, interconnected by a collar 18. The upper rod portion 17 is guided in a guide sleeve 19 which is screwed into the head 1 of the sewing machine. A spring 21, mounted on the upper rod portion 17, is disposed between the collar 18 and a constriction 20 in the guide sleeve 19. A lever arm 22, which is mounted to a widening 23 of the housing, is linked to the triangular lever 13. Another lever arm 24, likewise mounted to the housing widening 23, is linked to the lower end 16 of rod 15.

The motions of the top transport foot 7 and of the fabric presser foot 10 are generated by an eccentric drive. For this purpose, there is fastened to the arm shaft 5 an eccentric 25 which, via an eccentric rod 26, acts upon a pin 27 (see FIG. 2). The pin 27 is mounted so that it can swing around a pin 29 by means of a steering arm 28 and is connected via another steering arm 30 to another pin 31 attached to an arm 32 of an L-shaped angular lever 33. The angular lever 33 is mounted in the housing widening 23 and has a second arm 35 equipped with a curved slot 34. A shackle bolt 36 is fastened so as to be adjustable in the curved slot 34. A steering arm 37 is attached to the shackle bolt 36. The steering arm 37 acts upon a rocking lever 38, one end of which is mounted to the housing widening 23 while its other end is connected to the triangular lever 13 via a coupling member 39.

Another eccentric 40, connected via an eccentric rod 41 to one arm of a rocker 42, is fastened to the arm shaft 5. The rocker 42 is mounted in the widening 23 of the housing, by means of a pin 43. One arm **42*a* of the rocker 42 is connected via a joint 44 to a coupling member 45 and the coupling member 45 is connected, via a pin 46, to a rocking lever 47. The rocking lever 47 is mounted in the housing widening 23 by means of a pin 48 (FIG. 3) and at its upper end, carries the pin 29**.

The spring 21 (FIG. 1) is supported at its top by the constriction 20 of the guide sleeve 19 and pushes the triangular lever 13 in a downward direction via the rod 15 and the steering arm 14. Thus, the spring 21 generates the required contact pressure of the feet 7 and 10 against the stitch plate 49.

The two eccentrics 25 and 40 are driven to oscillate at a selected frequency by the rotation of the arm shaft 5. The eccentric 25 swings the steering arm 28 around the pin 29 via the eccentric rod 26.

Due to this motion, the steering arm 30, acting upon the pin 27, is also pivoted and, in turn, pivots the angular lever 33 which pivots the rocker 38 via the steering arm 37. The rocker 38 moves the upwardly projecting corner of the triangular lever 13 via the coupling member 39. In this process, the triangular lever 13 supports itself via the respective bar 6 or 8 and the respective steering arm 11 or 12 against the one of the two feet 7, 10 which assumes the lowest position, and raises or lowers the respective other foot 7 or 10.

The drive motion of the eccentric 25 results in a sinosoidal motion of the pin 27 which, in the course of its motion, swings through the axis of pin 48 (FIG. 3) and, hence, through the bearing center of the rocking lever 47.

The rocking lever 47 is pivoted about its pin 48 via the eccentric 40, the eccentric rod 41, the rocker 42 and the coupling member 45. In this process, the joint 44 is swung through the extended position of the coupling member 45, and the arm **42*a* connected thereto, designated by line M (FIG. 2), into two end positions A and B. The two end positions A and B, are located outside the extended position and are approximately equidistant from the extended position. At the same time, the coupling member 45 pivots the rocking lever 47 between two extreme positions L and R. In the central extended position M of joint 44 of the coupling member 45, the pin 29 assumes the position R, in which the two pins 29 and 31 have the greatest lateral distance from each other. In the two end positions A and B of the joining 44, however, the pin 29 assumes the position L, in which the two pins 29 and 31 are coaxial. Accordingly, the pin 29 performs a sine motion at twice the frequency of the sine motion of pin 27. The frequency of pin 27 is the selected frequency of the eccentric 25**.

Therefore, while the eccentric 25 exerts a normal, sineshaped or sinusoidal lifting motion on the two feet 7 and 10, the transmission ratio of this sine motion, predetermined by the eccentric 25, is varied from zero to a maximum by controlling the lateral distance between the pin 29 and the pin 31.

If is, of course, also possible, to select the dimensions of the components so that the pin 29 can be pivoted between the position R in the one extreme position and a position only approaching the position L in the other extreme position. In that case, the transmission ratio of the sine motion predetermined by the eccentric 25 is varied from a maximum to a minimum above zero.

The angular setting of the eccentric 40 relative to the eccentric 25 is selected so that, in the phases of motion when both feet 7 and 10 rest on the fabric being sewn, the pin 29 assumes the coaxial position L to the pin 31, or the position approaching L. Due to this arrangement, the normal sine-shaped motion of the feet 7 and 10 is reduced towards zero in the phases of motion in which the one or the other of the two feet 7,10 approaches the fabric being sewn, resulting in a reduction of the touchdown speed of the transport foot 7 and the presser foot 10. During the phase when the one or the other foot 7 or 10 is lifted off the fabric being sewn, on the other hand, the pivoting motion of the angular lever 33 is transmitted with the greatest transmission ratio.

By moving the steering arm 37 in the curved slot 34 of the angular lever 33 the amount of lift of the feet 7 and 10 can be varied to be able to adapt their stroke to the thickness of a fabric being sewn. FIG. 4 shows a diagram of the lifting motion 0 of the top transport 7 and the lifting motion S of the fabric holdown foot 10 (collectively labelled L in FIG. 4) at a certain setting of the steering arm 37 in the curved slot 34 as a function of the angular position $\emptyset$ of the arm shaft 5 of the sewing machine.

Figure 5:
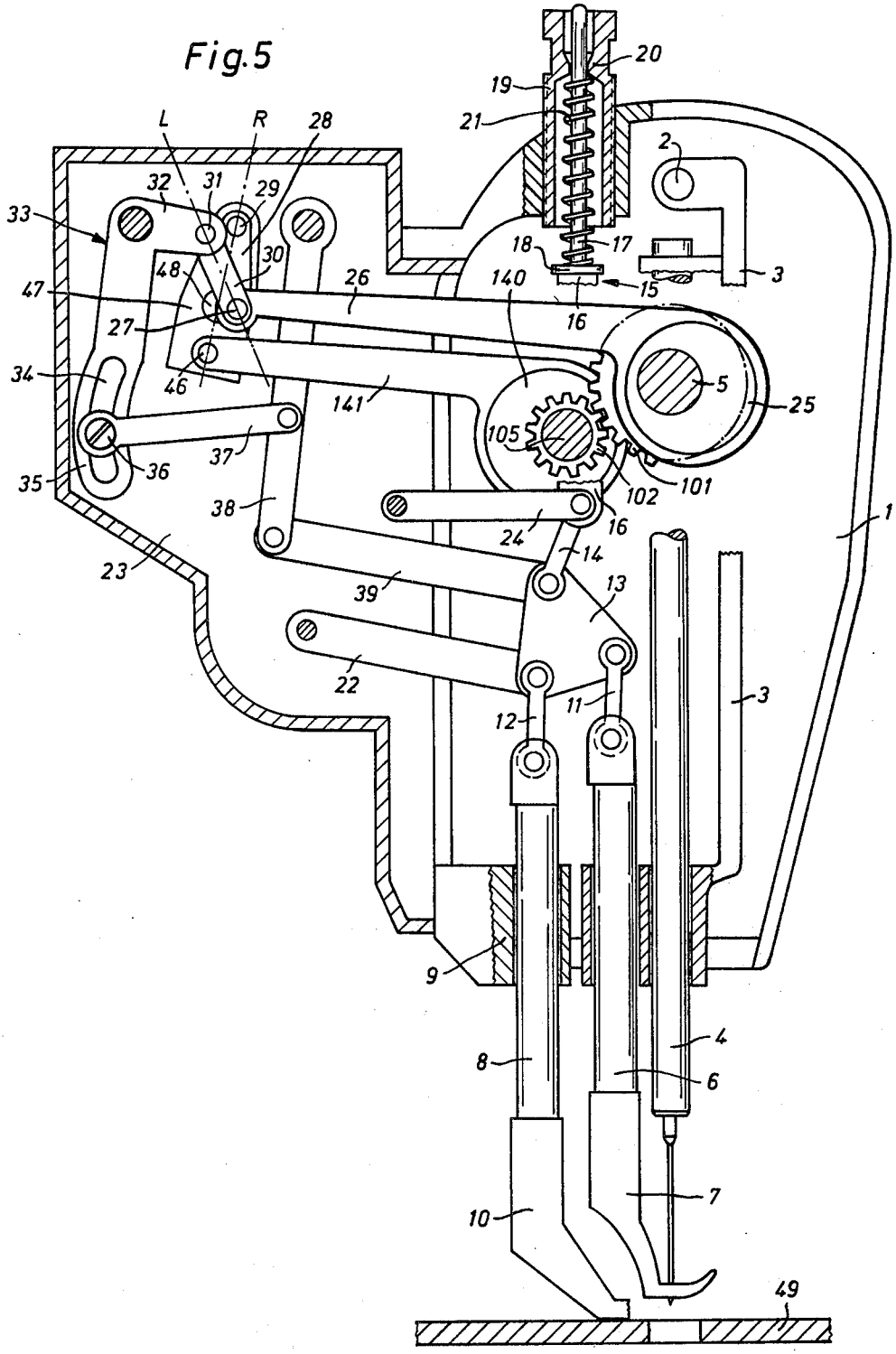
FIG. 5 is a front view of the sewing machine which is identical to that of FIG. 1 but with a second embodiment of the lifting drive.

FIG. 5 shows another embodiment of the top transport drive. This embodiment differs from that described hereinbefore only in that the drive to rock the rocking lever 47 is modified. In FIG. 5, only those components which are different from those in FIG. 1 have been given other reference symbols. A gear 101 which interacts with a gear 102 at a 1:2 transmission ratio, is mounted to the shaft 5. The gear 102 is mounted to a shaft 105 which is mounted parallel to shaft 5 in the machine housing 1 and carries an eccentric 140. The eccentric 140 is connected, via an eccentric rod 141, directly to the pin 46 of the rocking lever 47. During one revolution of the arm shaft 5, the shaft 105, driven by the gears 101 and 102, makes two revolutions so that the eccentric 140 rocks the rocking lever 47 twice into its extreme positions L and R via the eccentric rod 141, during each revolution of the arm shaft 5. This causes the pin 29 also to perform a sine motion at twice the frequency of the sine motion of the pin 27 driven by the eccentric 25, resulting in the same functional cycle as in the first embodiment example.

The other components of the embodiment according to FIG. 5 are identical in their design and their function with those of FIG. 1. Therefore, a repeated description of these components is omitted.

Thus, in accordance with the invention, there is provided a top transport device in a sewing machine, with a feeder foot and a fabric presser foot, the presser foot alternatingly interacting with the feeder foot, to which feet are imparted, by means of a coupling member driven by an eccentric 25 through a transmission comprising several components and via a triangular lever linked to said coupling member, up and down motions directed perpendicular to a stitch plate 49 of the sewing machine, the speed of said up and down motions tending to become "zero" in the touchdown phase of the feet, characterized in that there is disposed within the transmission 26, 28, 30, 33, 38 a steering arm transmission 28, 30, the transmission ratio of which is varied by a linkage transmission 40, 41, 42, 45 47 or 101, 140, 141, 47 acting with twice the frequency of the eccentric 25. In accordance with preferred features of the invention, the top transport device is further characterized in that the linkage transmission 40, 41, 42, 45, 47 includes a second eccentric 40 which is driven by the main shaft 5 and is joined to the steering arm transmission 28, 30 via an eccentric rod 41, a rocker 42, a coupling member 45 and a rocking lever 47 in such a manner that the joint 44 performs, between the coupling member 45 and the rocker 42, oscillatory motions between two points A and B which are the same distance apart from the extended position M of the coupling member 45 and the arm 42*a* of the rocker 42 connected thereto.

The linkage transmission 101, 140, 141, 47 may include an eccentric 140 which is driven by the main shaft at a 1:2 ratio and is connected, via an eccentric rod 141, to a lever arm of the rocker 47, having the same length as the steering arm 28 of the steering arm transmission 28, 30. The top transport device preferably may be further characterized in that the two transmissions 25, 26, 28, 30, 33, 37, 38 and 40, 41, 42, 45, 47 or 101, 140, 141, 47 are interconnected by two steering arms 28, 30 of the same length, one of them 28 being in drive connection with the coupling member 39 and the other 30 with the second eccentric 40 or 140 whereas their connecting joint 27 is connected to the first eccentric 25.

While specific embodiments of the invention have been shown and described in detail to illustrate the application of the principles of the invention, it will be understood that the invention may be embodied otherwise without departing from such principles.

I claim:

1. A transport device for a sewing machine having a housing, a feeder foot (7) and a fabric presser foot (10), drive means (5) for driving the feeder foot and the presser foot, transmission means operatively interconnecting the presser foot (10) and the feeder foot (7) to the drive means (5) for alternately reciprocating the feeder foot and the presser foot relative to each other in up and down motions directed perpendicular to a stitch plate (49) of the sewing machine, such that the speed of the up and down motions approach zero during a touchdown phase of the feeder foot and presser foot, the transmission means being of the type having an eccentric (25) connected to the drive means for oscillating in a selected frequency, a triangular lever (13) interconnecting the feeder foot and the presser foot, a coupling member (33) connected to the eccentric, and a linkage system (37,38,39) having a link pivotally connected to the housing and interconnecting the coupling member (33) to the triangular lever (13), the improvement wherein the transmission means comprises a steering arm transmission (28,30) having a variable transmission ratio between an input (27) thereof and an output (31) thereof, said steering arm transmission interconnected between the eccentric (25) and the coupling member (33) and oscillating at the selected frequency of the eccentric, the improvement further comprising a linkage transmission (40,41,42,45,47; 101, 140,141,47) connected to the drive means (5) and said steering arm transmission for varying the transmission ratio of said steering arm transmission, said linkage transmission connected to said drive means for operating at twice the selected frequency of the steering arm transmission and eccentric.

2. A transport device according to claim 1, wherein said linkage transmission includes a second eccentric (40) connected to the drive means for rotation, the second eccentric having an eccentric rod (41), a rocker (42) having a pair of arms pivotally connected to the housing and connected to said eccentric rod (41), a second coupling member (45), a joint (44) pivotally connecting said rocker (42) and said second coupling member (45), and a rocking lever (47) connected to said second coupling member (45) and the housing, and further connected to said steering arm transmission (28,30), said second eccentric being operable to oscillate the second coupling member through an extended position in which said second coupling member (45) and an arm of said rocker are substantially in line between two points which are equidistantly spaced on opposite sides of the stretched position responsive to the rotation of the drive means.

3. A transport device as set forth in claim 1, wherein said linkage transmission includes a second eccentric, gear means operatively connecting said second eccentric (140) to the drive means for driving said second eccentric at a 1:2 ratio, the second eccentric including an eccentric rod (141), a rocker lever (47) connected to said eccentric rod (141) and to the housing and operatively connected to said setting arm transmission.

4. A transport device as set forth in claims 2 or 3 wherein said steering arm transmission interconnects said linkage transmission and said transmission means, and wherein said steering arm transmission comprises a first steering arm and a second steering arm pivotally mounted at one end on a pin, each of said first steering arm and second steering arm having the same length, said first steering arm being in drive connection with the first coupling member and the second steering arm being in drive connection and said second eccentric, and said pin being connected to said first eccentric.

5. In a transport device for a sewing machine having a housing, a feeder foot and a fabric presser foot, drive means for driving the feeder foot and the presser foot, transmission means operatively interconnecting the presser foot and the feeder foot to the drive means for alternately reciprocating the feed foot and the presser foot relative to each other in up and down motions directed perpendicularly to a stitch plate of the sewing machine, such that the speed of the up and down motions approaches zero during a touchdown phase of the motion, the transmission means being of the type having an eccentric connected to the drive means, a triangular lever interconnecting the feeder foot and the presser foot, a coupling member connected to the eccentric, a linkage system having a link pivotally mounted to the housing and interconnecting the coupling member to the triangular lever, the improvement wherein the transmission means comprises a first multi-member transmission train (25,26,28,30,33,37,38) including steering arm means (28,30) having two input elements (29,31) movable to form a variable transmission ratio, and a second transmission train (41,42, 45,47; 101, 140, 141, 147) connected to a second one (29) of said two input elements for synchronizing a control of the transmission ratio, said transmission train connected to said drive means and structured to operate at twice a frequeny of oscillation of said first transmission train.

* * * * *